US006312537B1

(12) United States Patent
Hiskey et al.

(10) Patent No.: US 6,312,537 B1
(45) Date of Patent: Nov. 6, 2001

(54) LOW-SMOKE PYROTECHNIC COMPOSITIONS

(75) Inventors: Michael A. Hiskey, Los Alamos; David E. Chavez, Ranchos de Taos; Darren L. Naud, Los Alamos, all of NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 09/615,929

(22) Filed: Jul. 13, 2000

Related U.S. Application Data

(62) Division of application No. 09/295,728, filed on Apr. 20, 1999, now Pat. No. 6,214,139.

(51) Int. Cl.[7] ..... C06B 47/08; C06B 31/28; C06B 31/02; C06B 29/22

(52) U.S. Cl. ..... 149/36; 149/46; 149/61; 149/76

(58) Field of Search ..... 149/36, 46, 61, 149/76

(56) References Cited

U.S. PATENT DOCUMENTS

| | | | |
|---|---|---|---|
| 5,468,866 | 11/1995 | Highsmith et al. | 548/251 |
| 5,472,647 | 12/1995 | Blau et al. | 264/3.1 |
| 5,501,823 | 3/1996 | Lund et al. | 264/3.1 |
| 5,516,347 | 5/1996 | Highsmith et al. | 149/18 |
| 5,682,014 | 10/1997 | Highsmith et al. | 149/36 |
| 5,872,239 | 3/1999 | Burns et al. | 149/36 |
| 5,889,161 | 3/1999 | Bottaro et al. | 534/551 |
| 5,917,146 | 6/1999 | Hiskey | 149/36 |
| 5,962,808 | 10/1999 | Lundstrom | 149/19.1 |
| 6,017,404 | 1/2000 | Lundstrom et al. | 149/36 |

OTHER PUBLICATIONS

Conkling, "Pyrotechnics," Scientific America pp. 96–102, Jul. 1990.

*Primary Examiner*—Charles T. Jordan
*Assistant Examiner*—Aileen J. Baker
(74) *Attorney, Agent, or Firm*—Bruce H. Cottrell

(57) ABSTRACT

A low-smoke producing pyrotechnic composition including a high-nitrogen content, low-carbon content energetic material, an oxidant and a colorant is disclosed together with the use of selected metal salts of a high-nitrogen content, low-carbon content energetic material as the colorant.

6 Claims, 2 Drawing Sheets

LOW-SMOKE PYROTECHNIC COMPOSITIONS

This application is a division of Ser. No. 09/295,728 filed Apr. 20, 1999 now U.S. Pat. No. 6,214,139.

FIELD OF THE INVENTION

The present invention relates to pyrotechnic compositions and more particularly to low-smoke pyrotechnic compositions including a high-nitrogen content, low-carbon content energetic material. Additionally, the present invention relates to low-smoke pyrotechnic compositions including metal salts of a high-nitrogen content, low-carbon content energetic material as colorant This invention was made with government support under a contract with the Department of Energy (Contract No. W-7405-ENG-36).

BACKGROUND OF THE INVENTION

Amusement parks often employ pyrotechnic compositions in the form of colorful fireworks. Unfortunately, the burning of large quantities of such pyrotechnics can generate large amounts of smoke and depending upon the particular weather conditions, such as wind direction, wind speed and relative humidity, the smoke can block the view of further fireworks or can envelop the audiences.

Fireworks projectiles typically include two components, an initial burst and a main burst. Black powder is one of the oldest pyrotechnic compositions and is typically used in both the initial burst and the main burst. The main burst also includes smaller color-producing pellets referred to as "stars". Igniting these stars during detonation of the main burst provides the light and color of a fireworks display. Among typical compositions for a red star have been: (1) potassium chlorate, strontium carbonate, charcoal, red gum (shellac), and dextrin (or rice starch); (2) potassium perchlorate, strontium carbonate, charcoal, red gum (or shellac), dextrin (or rice starch) and polyvinyl chloride; or (3) strontium nitrate, red gum (or shellac), magnalium (an alloy of aluminum and magnesium) and Parlon® chlorinated rubber $(C_6H_6Cl_4)_n$. Unfortunately, all such typical compositions generate various quantities of smoke.

One low-smoke pyrotechnic composition including a high-nitrogen content, low-carbon content energetic material from the group of dihydrazino-s-tetrazine, derivatives of dihydrazino-s-tetrazine and salts of dihydrazino-s-tetrazine, an oxidizing agent, and a colorant was described by pending U.S. application Ser. No. 08/865,412, entitled "High-Nitrogen Energetic Material Based Pyrotechnic Compositions" by Hiskey et al., filed on May 29, 1997. As dihydrazino-s-tetrazine materials are relatively expensive, the search for other low-smoke pyrotechnic compositions has continued.

Additional efforts have dealt with a search for replacement colorants to be used in low smoke pyrotechnic compositions in place of previous colorants such as cupric oxide, barium nitrate, strontium nitrate and the like. U.S. Pat. No. 5,682,014 by Highsmith et al. describes metal salts of a bitetrazoleamine such as bis1(2)H-tetrazol-5-yl)-amine (BTA) as non-azide fuels for gas generant compositions.

It is an object of this invention to provide a low smoke pyrotechnic composition, preferably an essentially smoke-free pyrotechnic composition.

Another object of the present invention is to provide a pyrotechnic composition including a high-nitrogen content, low-carbon content energetic material.

Another object of the present invention is the use of metal salts of a high-nitrogen content, low-carbon content energetic material as a colorant in a pyrotechnic composition.

Still another object of the present invention is an improved blue emitting pyrotechnic composition.

SUMMARY OF THE INVENTION

To achieve the foregoing and other objects, and in accordance with the purposes of the present invention, as embodied and broadly described herein, the present invention provides a low-smoke pyrotechnic composition including a high-nitrogen content, low-carbon content energetic material selected from the group consisting of 5,5'-bis-1H-tetrazole, salts of 5,5'-bis-1H-tetrazole, bis(1(2)H-tetrazol-5-yl)-amine, the monohydrate of bis(1(2)H-tetrarol-5-yl)-amine, salts of bis(1(2)H-tetrazol-5-yl)-amine; an oxidizing agent; and a colorant.

The present invention further provides a pyrotechnic composition including a high-nitrogen content, low-carbon content energetic material; an oxidiziig agent; and, a metal salt of a high-nitrogen content, low-carbon content energetic material as a colorant.

DETAILED DESCRIPTION

Figure 1:
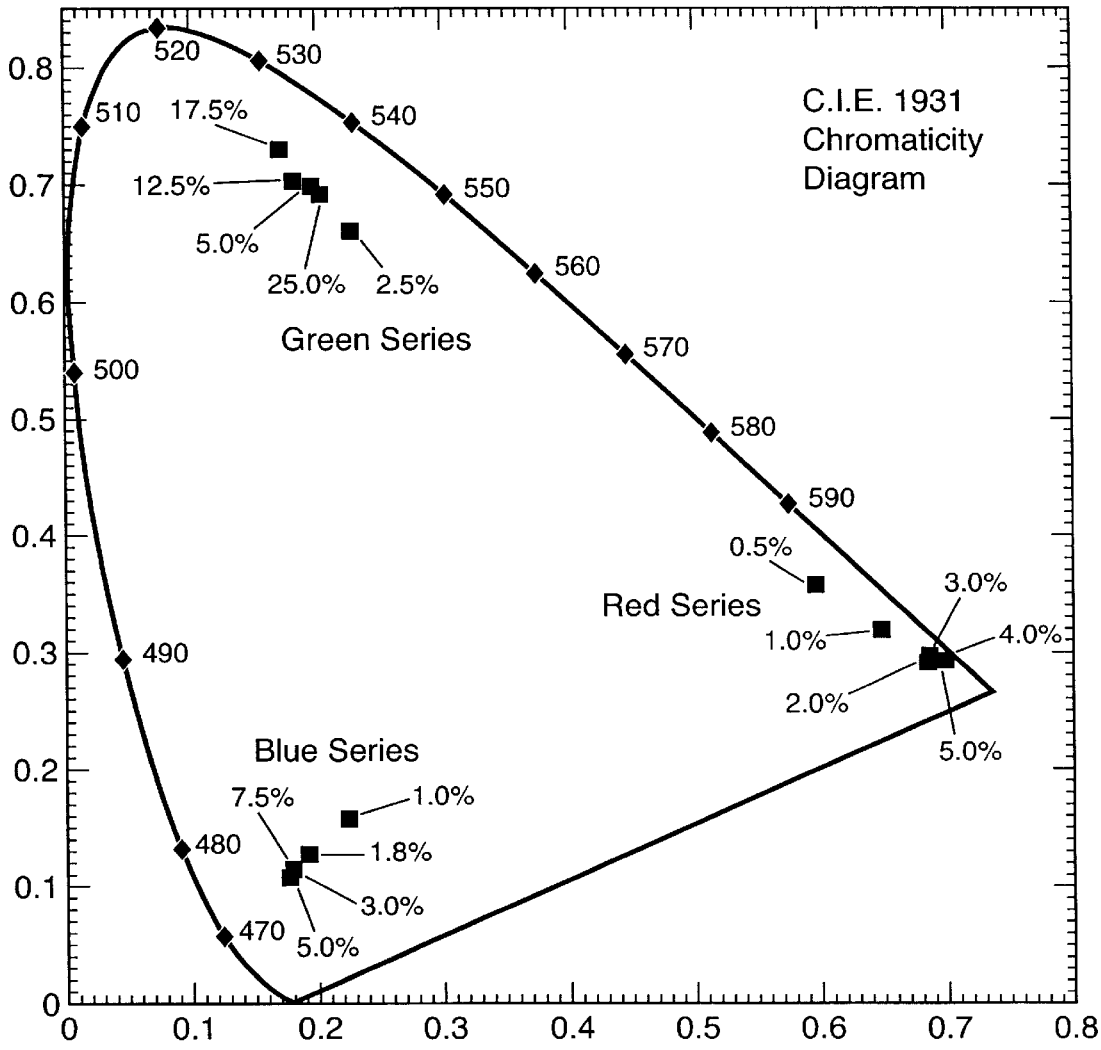
FIG. 1 shows a C.I.E. 1931 chromaticity diagram for various pyrotechnic compositions of the present invention showing the effect of colorant concentration on flame color where the concentrations of metal colorants are in weight percent.

The present invention is concerned with pyrotechnic compositions and especially with fireworks compositions. The fireworks compositions of the present invention are characterized as low-smoke compositions and can be formulated essentially smoke-free.

The pyrotechnic compositions of the present invention include a high-nitrogen content, low-carbon content energetic material as a principal component. Among suitable high-nitrogen content energetic materials are included salts of 5,5'-bis-1H-tetrazole ($2M^+C_2N_8^{2-}$ where M is selected from the group consisting of di-hydrazinium ($NH_2NH_3^+$) di-hydroxylammonium ($HONH_3^+$), di-ammonium, and 3,6-dihydrazino-s-tetrazinium ($^+H_3NHN—(N_4C_2)—NHNH_3^+$)), bis(1(2)H-tetrazol-5-yl)-amine ($C_2H_3N_9$), the monohydrate of bis(1(2)H-tetrazol-5-yl)-amine ($C_2H_3N_9.H_2O$), and salts of bis(1(2)H-tetrazol-5-yl)-amine and its hydrate ($M^+C_2H_2N_9^-$ and $2M^+C_2HN_9^{2-}.xH_2O$).

While not wishing to be bound by the present explanation, it is believed that the heat of formation of an energetic material and the burn rate of the material are important considerations in the selection of the energetic material. It has been previously found that not any high-nitrogen content, low-carbon content energetic material gave the desired results as while dihydrazino-s-tetrazine has been found useful for pyrotechnic compositions, the material trihydrazino-triazine has failed as an energetic material for pyrotechnic compositions.

In addition to the high-nitrogen content, low-carbon content energetic materials, the pyrotechnic compositions of the present invention include an oxidizer. Suitable oxidizers can generally include ammonium perchlorate, alkali perchlorates such as potassium perchlorate and the like, ammonium nitrate, and alkali nitrates such as potassium nitrate and the like. Alkali chlorates may be employed as an oxidizer but are generally not preferred due to sensitivity problems. Ammonium perchlorate and ammonium nitrate are preferred oxidizers as the absence of any metal ions is better for control of the fireworks color and eliminates any ash residue. Ammonium perchlorate is especially preferred as the oxidizer as it has the added benefit of providing a source of chlorine to the pyrotechnic composition. It is generally known that a good quality pyrotechnic flame requires a source of chloride ions. Also, ammonium nitrate is hygroscopic and compositions including ammonium nitrate must be protected from moisture.

The oxidizer is generally added with the high-nitrogen content, low-carbon content energetic materials in amounts sufficient to provide about three equivalents of free oxygen. Generally, the compositions can include from about 30 percent by weight to about 60 percent by weight of the high-nitrogen content, low-carbon content energetic material, more preferably from about 35 percent by weight to about 55 percent by weight, together with about 40 to about 60 percent by weight of the selected oxidizer. Colorant is also added together with the fuel and oxidizer.

Various metal salts can be employed as colorants or coloring agents to generate selected colors for the pyrotechnic compositions. Those skilled in the art recognize that each metal of the periodic table has well-known spectra associated with the burning of such metals. Among the metal salts are calcium salts such as calcium carbonate for the color red-orange, strontium salts such as strontium nitrate for the color red, barium salts such as barium nitrate for the color green, boron compounds for the color green, sodium salts such as sodium nitrate for the color orange-yellow, copper salts such as copper oxide for the color blue, potassium salts such as potassium chloride for the color purple or violet, and antimony salts such as antimony sulfide for the color white. Combinations of metal salts can yield other desirable colors. For example, a combination of calcium carbonate and sodium nitrate gives an orange color, a combination of copper sulfide and strontium nitrate has given a red-purple color, and a combination of barium nitrate and sodium nitrate has given a yellow color. Other metal salts such as cadmium, uranium, gold, mercury, arsenic, iron and lead may be used to provide other colors if desired, although many such salts are not generally preferred due to toxicity. Nitrate salts are generally more preferred than chloride salts as chloride salts tend to occur as hydrates and thus contribute undesired water. The colorant is generally added in amounts from about 0.5 percent by weight to about 20 percent by weight, preferably from about 1 percent by weight to about 10 percent by weight based on the total weight of fuel, oxidant and colorant.

Another aspect of the present invention is the use of a metal salt of a high-nitrogen content, low-carbon content energetic material as the colorant. For example, metal salts can be formed from 5,5'-bis-1H-tetrazole, bis(1(2)H-tetrazol-5-yl)amine, and the monohydrite of bis(1(2)H-tetrzol-5-yl)-amine. The metal salts can generally include the metals conventionally used in pyrotechnic compositions. For example, strontium, barium, copper, and iron salts of 5,5'-bis-1H-tetrazole, bis(1(2)H-tetrazol-5-yl)amine, and the monohydrate of bis(1(2)H-tetrazol-5-yl)-amine can yield red, blue, green, yellow, purple, red-purple, and blue-green colorants. Use of these metal salts of a high-nitrogen content, low-carbon content energetic material as the colorant are generally preferred in low smoke pyrotechnic compositions employing the same or other high-nitrogen content, low-carbon content energetic materials as they can be used in low amounts, generally less than about 10 percent by weight and yield intense colors. A blue colorant of the copper salt of the monohydrate of bis(1(2)H-tetrazol-5-yl)-amine has produced an intense blue color in an area of the spectrum not previously seen with conventional colorants. Specifically, this colorant yields color coordinates in the C.I.E. 1931 coordinate system of $x<0.2$ to as low as $x=0.17$ and $y<0.18$ to as low as $y=0.11$. As noted by Conkling, Scientific American, "Pyrotechnics", pp. 96–102, July 1990, it is well recognized by those of skill in the art that the blue emission color is highly challenging.

Chlorine can be added to the compositions by addition of a metal chloride salt as the colorant or by use of ammonium perchlorate as the oxidizer. Use of ammonium perchlorate as the oxidizer or as part of the oxidizer is generally preferred to supply the chloride ions.

Metal flakes or particles may be added to the pyrotechnic compositions to provide a glitter effect. Suitable metals can include aluminum, magnesium, titanium and iron. Iron can generally be added in the form of steel shavings to avoid rusting problems from moisture.

One preferred pyrotechnic formulation including ammonium perchlorate as the oxidizer includes about 5 percent by weight of the selected colorant or coloring agent with the remainder being about equal amounts by weight of the ammonium perchlorate oxidizer and the high-nitrogen content, low-carbon content energetic material.

The pyrotechnic compositions of the present invention can be arranged into a typical shell construction or as a typical roman candle construction as are commonly used in the fireworks industry. Such common constructions generally include a multiple of stars formed of the pyrotechnic compositions of the present invention together with appropriate amounts of black powder, bursting charge, any necessary lifting charge and any necessary time delay fusing.

The present invention is more particularly described in the following examples which are intended as illustrative only, since numerous modifications and variations will be apparent to those skilled in the art.

EXAMPLE

The syntheses of numerous salts of bis(1(2)H-tetrazol-5-yl)-amine monohydrate and bis-5,5'-1H-tetrazol are similar with the general method of synthesis described below with the exact quantities and reagents also detailed specifically below. The general process includes adding the bis(1(2)H-tetrazol-5-yl)amine monohydrate or bis-5,5'-1H-tetrazole to a sufficient amount of deionized water for recrystallization together with one or two equivalents of organic amine or metal hydroxide. The resulting slurry mixtures were stored and heated to boiling, and where necessary, filtered hot to remove insoluble impurities. The clear solutions were cooled by an ice bath to about 10° C. with vigorous stirring to initiate precipitation. The salts were collected by filtration and air-dried.

5,5'- Bis-1H-tetrazole (BT) was synthesized as follows. Into a five-liter flask with 2.4 liter (L) of water was added sodium azide (260 grams (g)) and sodium cyanide (200 g). While stirring and cooling by an ice bath, manganese dioxide (220 g) was added. Afterwards, a solution of concentrated sulfuric acid (400 g), glacial acetic acid (320 g) and cupric sulfate pentahydrate (8 g) previously dissolved in water (1.0 L) was added at a rate so that the reaction temperature was between about 20° C. and 30° C. After the addition, the reaction was brought to 90° C. over a one-hour period and maintained between 90° C. and 95° C. for three hours. The reaction was cooled and the crude product, possibly containing some copper salts, was filtered off and air-dried to yield 390 g of manganese 5,5'-Bis-1H-tetrazole.

A slurry of manganese 5,5'-Bis-1H-tetrazole (200 g) and water (1.6 L) was formed and sodium carbonate (120 g) was added in portions over a 10 minute period. The resulting mixture was boiled for 1.5 hours, filtered and the solids washed with 200 ml of boiling water. The filtrates were combined and neutralized with concentrated hydrochloric acid until carbon dioxide evolution stopped. An excess amount of concentrated hydrochloric acid (140 ml) was added to ensure the precipitation of the di-acid compound as opposed to the less soluble acid-sodium salt. At this point any soluble copper salts were precipitated by (1) titrating the solution with a 5% sodium sulfide solution; or (2) bubbling hydrogen sulfide gas through the solution. Thereafter, the solution was reduced to 700 ml by boiling, cooled to 0° C., and filtered to remove the crude product.

The diammonium salt of 5,5'-Bis-1H-tetrazolate (DA-BT) was prepared by reacting 5,5'-Bis-1H-tetrazole (10 g) and 20 ml of concentrated ammonium hydroxide in 300 ml of water. This salt is also commercially available from Summit Pharmaceuticals Corp., Fort Lee, N.J.

The dihydrazinium salt of 5,5'-Bis-1H-tetrazolate (DHz-BT) was prepared by reacting 5,5'-Bis-1H-tetrazole (15 g) and hydrazine monohydrate (11 g) in 100 ml of water. This salt has been found to lose about 0.6 hydrazine at about 130° C. and to lose the remaining hydrazine at about 200° C. As a result of this decomposition, this salt was one of the poorest performing fuels. Star samples prepared with this salt melted and decomposed before catching fire. However, stars formed with copper salts burned with relative ease, a result attributed to the catalytic effect of the copper salts on hydrazine. One suggested use for this salt is as an additive to adjust the ignitibility or burn characteristics of pyrotechnic compositions.

The hydrazinium salt of 5,5'-Bis-1H-tetrazolate (Hz-BT) was prepared by reacting 5,5'-Bis-1H-tetrazole (8.0 g) and hydrazine monohydrate (2.9 g) in 50 ml of water. Thermogravimetric analysis (TGA) indicated that this monoamine salt was thermally stable to 175° C.

The ammonium salt of 5,5'-Bis-1H-tetrazolate (A-BT) was prepared by reacting 5,5'-Bis-1H-tetrazole (1.38 g) and concentrated ammonium hydroxide (0.58 g) in 10 ml of 50% ethanol. The solution was heated until clear and cooled by an ice bath to initiate precipitation.

The dihydroxylammonium salt of 5,5'-Bis-1H-tetrazolate (HA-BT) was prepared by reacting 5,5'-Bis-1H-tetrazole (30 g) and 50% hydroxylamine solution (27 ml) in 1 L of water.

The hydroxylammonium salt of 5,5'-Bis-1H-tetrazolate (HA-BT) was prepared by reacting 5,5'-Bis-1H-tetrazole (22.5 g) and 50% hydroxylamine solution (10 ml) in 90 ml of water.

The barium salt of 5,5'-Bis-1H-tetrazole tetrahydrate (Ba-BT4w) was prepared by reacting 5,5'-Bis-1H-tetrazole (3.20 g) and barium hydroxide octahydrate (7.40 g) in 200 ml of water. This salt was found to lose its four hydrated water molecules in two stages. Two water molecules were readily lost when the barium salt was heated to about 40° C. and the remainder lost when heated to about 90° C. This salt was found thermally stable up to 300° C.

The strontium salt of 5,5'-Bis-1H-tetrazolate tetrahydrate (Sr-BT4w) was prepared by reacting 5,5'-Bis-1H-tetrazole (1.37 g) and strontium hydroxide octahydrate (2.66 g) in 50 ml of water. This salt was found to lose its four hydrated water molecules when heated to about 75° C. This salt was found thermally stable up to 300° C.

The copper salt of 5,5'-Bis-1H-tetrazolate dihydrate (Cu-BT2w) was prepared by adding cupric sulfate pentahydrate (2.5 g) in 20 ml of water to a warm solution of 5,5'-Bis-1H-tetrazole (1.38 g) in 50 ml of water. The bright blue solid was filtered and air-dried. This salt was found to lose one of its hydrated water molecules very readily below 80° C. and to lose its other water molecule between 80° C. and 110° C. This salt was found to begin thermal decomposition at from about 140° C. to about 145° C.

The 3,6-dihydrazino-s-tetrazinium salt of 5,5'-Bis-1H-tetrazolate dihydrate (DHT-BT2w) was prepared by adding 3,6-dihydrazino-s-tetrazine (14.2 g) to 5,5'-Bis-1H-tetrazole (13.8 g) in 200 ml of water. The slurry was stirred for 48 hours whereupon the original red color of the 3,6-dihydrazino-s-tetrazine changed to a bright orange. The aqueous mixture was filtered and air-dried. This material loses its two hydrated water molecules when heated to about 75° C., and its onset of decomposition was measured as about 154° C.

Bis(1(2)H-tetrzol-5-yl)-amine monohydrate (BTAw) was synthesized following example 27 of U.S. Pat. No. 5,468,866 by Highsmith et al. Purification of the product was found critical for proper burn and flame coloration in subsequent pyrotechnic compositions. This was done by recrystallization from water. To 4 L of boiling water was added 85 g of crude bis(1(2)H-tetrazol-5-yl)-amine monohydrate product The mixture was filtered hot and slowly cooled with stirring. The material was collected by filtration and air-dried. The impact sensitivity of pure bis(1(2)H-tetrazole-5-yl)amine monohydrate was found as greater than 320 cm, but this value dropped to between 26 and 34 cm when the material was converted to the anhydrous form. Thus, it is preferable to not use the anhydrous form in pyrotechnic compositions.

The diammonium salt of bis(1(2)H-tetrazol-5yl)-amine monohydrate (DA-BTAw) was prepared by reacting bis(1(2)H-tetrazol-5-yl)-amine monohydrate (5.8 g) and ammonium hydroxide (5.7 g) in 30 ml of water.

The ammonium salt of bis(1(2)H-tetrzol-5-yl)-amine (A-BTA) was prepared by reacting bis(1(2)H-tetrazol-5-yl)-amine monohydrate (17.1 g) and concentrated ammonium hydroxide (5.8 g) in 500 ml of water.

The dihydrazinium salt of bis(1(2)H-tetrazol-5-yl)-amine monohydrate (DHz-BTAw) was prepared by reacting bis(1(2)H-tetrazol-5-yl)-amine monohydrate (17.1 g) and hydrazine monohydrate (10.5 g) in 175 ml of water. Heating this material for 1 hour at 70° C. readily converts it to the anhydrous form.

The hydrazinium salt of bis(1(2)H-tetrazol-5-yl)-amine (Hz-BTA) was prepared by mixing hydrazine monohydrate (2.4 g) and bis(1(2)H-tetrazol-5-yl)-amine monohydrate (8.0 g) in 125 ml of water.

The strontium salt of bis(1(2)H-tetrazol-5-yl)-amine tetrahydrate (Sr-BTA4w) was prepared by mixing bis(1(2)H-tetrazol-5-yl)-amine monohydrate (6.3 g) and strontium hydroxide octahydrate (10 g) in 400 ml of water. This salt was found to lose its four hydrated water molecules when heated to about 115° C.

The barium salt of bis(1(2)H-tetrazol-5-yl)-amine tetrahydrate (Ba-BTA4w) was prepared by mixing bis(1(2)H-tetrazol-5-yl)-amine monohydrate (2.6 g) and barium hydroxide octahydrate (5.0 g) in 300 ml of water. This salt readily loses three of its four hydrated water molecules when heated to about 65° C., and loses the fourth water at about 200° C.

The copper salt of bis(1(2)H-tetrazol-5-yl)-amine dihydrate (Cu-BTA2w) was prepared by mixing a boiling solution of 50 ml of water and bis(1(2)H-tetrazol-5-yl)-amine monohydrate (1.0 g) with a solution of cupric sulfate pentahydrate (1.5 g) in 20 ml of water. The green precipitate was filtered and air-dried.

The flame color of various star compositions was measured using an Ocean Optics S2000 Series Fiber Optic Spectrophotometer coupled to a SAD500 interface. The diffractive grating was type 2 (200–850 nm) and the entrance slit was 25 microns wide. The instrument wavelength response was calibrated with a LS-1 tungsten halogen light source obtained from Ocean Optics. While Ocean Optics describes the light source to have a 3100 K color temperature, a color temperature of 3035 K was used to calculate the emittance data as a function of wavelength using Planck's formula. With these emittance values and the spectral data of the tungsten halogen lamp, wavelength dependent correction coefficients were calculated and entered into a spreadsheet. The spreadsheet was used to tabulate spectal data, correct instrument response, integrate the emittance in 5 nm portions and calculate a color coordinate based on C.I.E. 1931 tri-stimulus coefficients. Some formulations were burned as powder mixes while others were burned as stars. Stars were made by wetting the formulations with deionized water, pressing into shape and air-drying. No discernable spectral difference was found between the powder and star samples. The samples were burned on a ceramic plate and the position of the optic fiber lens relative to the burning sample was adjusted to obtain the best response of the spectrophotometer. Multiple burns were recorded, analyzed, and the resulting color coordinate values were averaged. Reproducibility was generally good with an estimated variability of +/−0.01 in the color coordinates. The data am shown in Table 1.

TABLE 1

| Color | Composition, weight percentages | | | x coordinate | y coordinate |
|---|---|---|---|---|---|
| Red | DHT | AP | Sr-BT4w | | |
| | 47.5 | 47.5 | 5.0 | 0.697 | 0.291 |
| | 48.0 | 48.0 | 4.0 | 0.699 | 0.292 |
| | 48.5 | 48.5 | 3.0 | 0.687 | 0.295 |
| | 49.0 | 49.0 | 2.0 | 0.685 | 0.290 |
| | 49.5 | 49.5 | 1.0 | 0.649 | 0.318 |
| | 49.75 | 49.75 | 0.5 | 0.597 | 0.356 |
| Green | BTAw | AP | Ba-BT4W | | |
| | 25.0 | 50.00 | 25.0 | 0.204 | 0.693 |
| | 32.5 | 50.00 | 17.5 | 0.171 | 0.731 |
| | 37.5 | 50.00 | 12.5 | 0.182 | 0.705 |
| | 45.0 | 50.00 | 5.0 | 0.196 | 0.700 |
| | 47.5 | 50.00 | 2.5 | 0.228 | 0.662 |
| Blue | BTAw | AP | Cu-BT2W | | |
| | 46.25 | 46.25 | 7.5 | 0.179 | 0.115 |
| | 47.5 | 47.5 | 5.0 | 0.1.77 | 0.108 |
| | 48.5 | 48.5 | 3.0 | 0.182 | 0.113 |
| | 49.1 | 49.1 | 1.8 | 0.193 | 0.128 |
| | 49.5 | 49.5 | 1.0 | 0.215 | 0.157 |
| Red | DHA-BT | AP | Sr-BT4w | | |
| | 47.5 | 47.5 | 5.0 | 0.710 | 0.290 |
| | DHz-BT | AP | Sr-BT4w | | |
| | 42.5 | 52.5 | 5.0 | 0.673 | 0.303 |
| | DA-BT | AP | Sr-BT4w | | |
| | 42.5 | 52.5 | 5.0 | 0.696 | 0.291 |
| | DA-BTA | AP | Sr-BT4w | | |
| | 38.0 | 57.0 | 5.0 | 0.695 | 0.294 |
| | BTAw | AP | Sr-BT4w | | |
| | 47.5 | 47.5 | 5.0 | 0.700 | 0.289 |
| Blue | DHT | AP | Cu-BTA2w | | |
| | 47.5 | 47.5 | 5.0 | 0.206 | 0.144 |
| | DHT-BT2w | AP | Cu-BTA2w | | |

TABLE 1-continued

| Color | Composition, weight percentages | | | x coordinate | y coordinate |
|---|---|---|---|---|---|
| | 47.5 | 47.5 | 5.0 | 0.187 | 0.123 |
| | DHA-BT | AP | Cu-BTA2w | | |
| | 47.5 | 47.5 | 5.0 | 0.189 | 0.136 |
| | HA-BT | AP | Cu-BTA2w | | |
| | 47.5 | 47.5 | 5.0 | 0.193 | 0.129 |
| | DHz-BT | AP | Cu-BTA2w | | |
| | 42.5 | 52.5 | 5.0 | 0.221 | 0.165 |
| | Hz-BT | AP | Cu-BTA2w | | |
| | 40.0 | 55.0 | 5.0 | 0.197 | 0.131 |
| | DA-BT | AP | Cu-BTA2w | | |
| | 42.5 | 52.5 | 5.0 | 0.182 | 0.116 |
| | Hz-BTA | AP | Cu-BTA2w | | |
| | 40.0 | 55.0 | 5.0 | 0.200 | 0.126 |
| | DA-BTA | AP | Cu-BTA2w | | |
| | 38.0 | 57.0 | 5.0 | 0.188 | 0.121 |
| | A-BTA | AP | Cu-BTA2w | | |
| | 40.0 | 55.0 | 5.0 | 0.185 | 0.121 |
| Green | DHT-BT2w | AP | Ba-BT4w | | |
| | 46.5 | 46.5 | 7.0 | 0.212 | 0.675 |
| | HA-BT | AP | Ba-BT4w | | |
| | 46.5 | 46.5 | 7.0 | 0.204 | 0.684 |
| | DHz-BT | AP | Ba-BTA4w | | |
| | 42.0 | 51.0 | 7.0 | 0.265 | 0.636 |
| | Hz-BT | AP | Ba-BT4w | | |
| | 39.0 | 54.0 | 7.0 | 0.186 | 0.714 |
| | DA-BT | AP | Ba-BTA4w | | |
| | 51.0 | 42.0 | 7.0 | 0.227 | 0.674 |
| | Hz-BTA | AP | Ba-BT4w | | |
| | 39.0 | 54.0 | 7.0 | 0.331 | 0.578 |
| | DA-BTA | AP | Ba-BT4w | | |
| | 37.0 | 56.0 | 7.0 | 0.311 | 0.613 |
| | A-BTA | AP | Ba-BT4w | | |
| | 39.0 | 54.0 | 7.0 | 0.204 | 0.685 |
| | DHA-BT | AP | $BaF_2$ | | |
| | 46.5 | 46.5 | 7.0 | 0.230 | 0.640 |
| Purple | DHA-BT | AP | Cu-BTA2w + Sr-BT4w | | |
| | 43.5 | 52.0 | 2.7 + 1.8 | 0.352 | 0.179 |
| | 43.5 | 52.0 | 1.8 + 2.7 | 0.446 | 0.214 |
| | BTAw | AP | Cu-BTA2w + Sr-BTA4w | | |
| | 47.5 | 47.5 | 2.1 + 3.1 | 0.446 | 0.214 |
| Blue-Green | BTAw | AP | Cu-BTA2w + Ba-BT4w | | |
| | 46.5 | 46.5 | 0.3 + 6.7 | 0.185 | 0.471 |
| | Hz-BT | AP | Cu-BTA2w + Ba-BT4w | | |
| | 41.2 | 51.4 | 0.3 + 7.1 | 0.219 | 0.587 |
| | DHA-BT | AP | Cu-BTMw + Ba-BT4w | | |
| | 42.3 | 50.7 | 0.2 + 6.8 | 0.209 | 0.588 |

Figure 2:
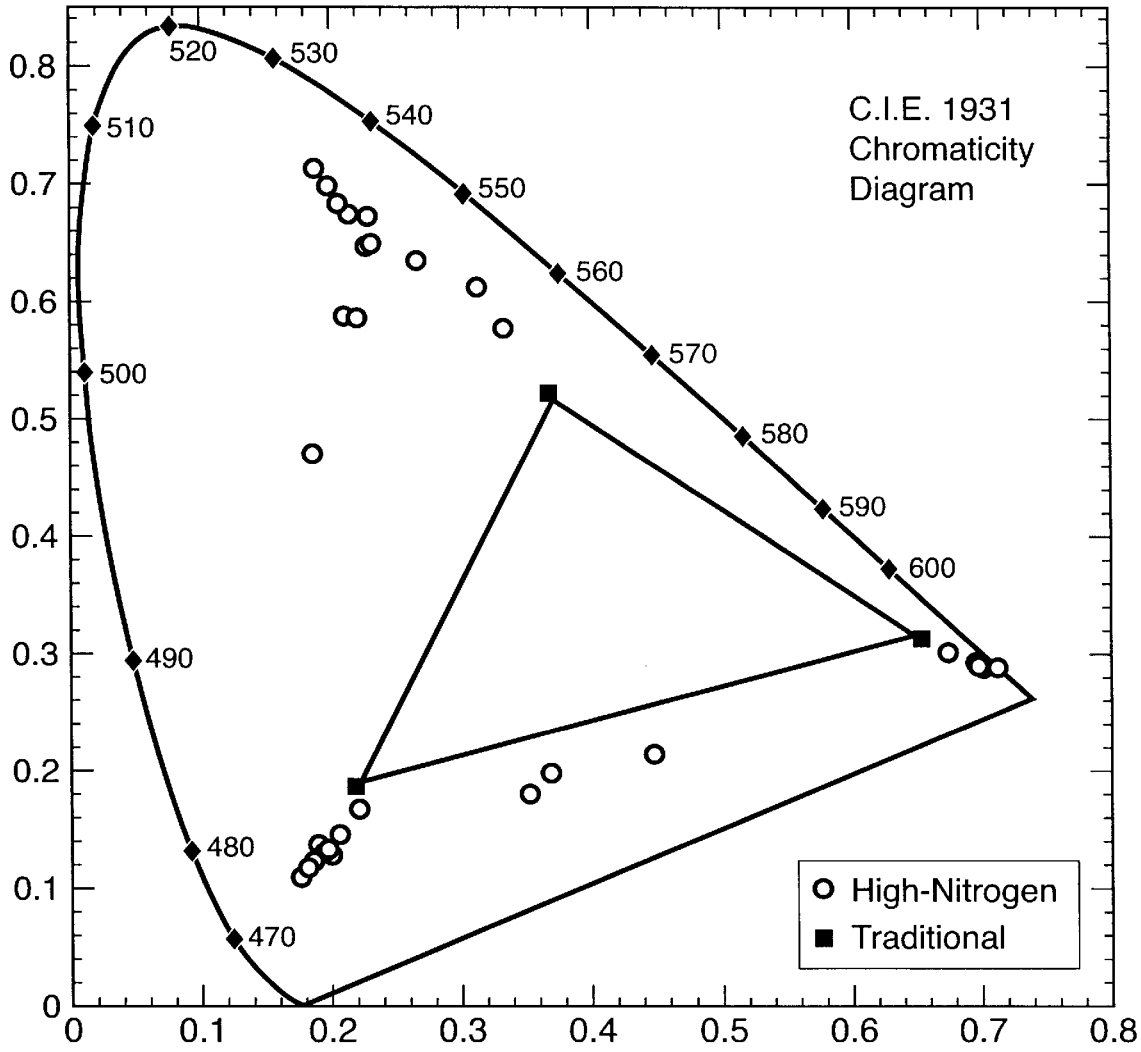
FIG. 2 shows a C.I.E. 1931 chromaticity diagram for various pyrotechnic compositions of the present invention and various prior art pyrotechnic compositions.

To compare the enhanced color purity from the compositions of the present invention, FIG. 2 shows the 1931 C.I.E. chromaticity and the color coordinates taken from samples in Table 1. The chromaticity diagram is a reasonable attempt to characterize visually observed color in a 2-D coordinate system. The three-color coordinates of traditional formulations are plotted as the dark boxes. A traditional red composition of 60 percent by weight strontium nitrate, 20 percent by weight magnalium alloy, 10 percent by weight polyvinyl chloride and 10 percent by weight red gum had coordinates of x=0.653 and y=0.315. A traditional blue composition of 61 percent by weight potassium perchlorate, 17 percent by weight cupric oxide, 10 percent by weight polyvinyl chloride, 6 percent by weight hexamine, 3 percent by weight red gum and 3 percent by weight dextrin had coordinates of x=0.218 and y=0.185. A traditional green composition of 56 percent by weight barium nitrate, 18 percent by weight polyvinyl chloride, 10 percent by weight magnalium alloy, 6 percent by weight potassium perchlorate, 5 percent by weight red gum and 5 percent by weight hexamine had coordinates of x=0.366 and y=0.522. The center triangular region connecting these three boxes represents the approximate region of colors possible when different ratios of the primary colors, i.e., green (from barium), blue (from copper) and red (from strontium) are mixed in a formulation and burned. The pyrotechnic formulations of the present invention yield color coordinates falling outside of the traditional region as shown by the triangle. Thus, the color purity of pyrotechnic flames can be improved by use of the high-nitrogen energetic materials and colorants of such high nitrogen energetic materials.

The compositions of the present invention can be used as fireworks for outdoors displays or may be used indoors, e.g., as fireworks for indoor firework displays or in the production of special effects for the film industry.

Although the present invention has been described with reference to specific details, it is not intended that such details should be regarded as limitations upon the scope of the invention, except as and to the extent that they are included in the accompanying claims.

What is claimed is:

1. In a low-smoke producing pyrotechnic composition including a low smoke fuel; an oxidizing agent; and, a colorant, the improvement wherein said colorant is a metal salt of a high-nitrogen content, low-carbon content energetic material selected from the group consisting of 5,5'-bis-1H-tetrazole, bis(1(2)H-tetrazol-5-yl)-amine, and the monohydrate of bis(1(2)H-tetrazol-5-yl)-amine.

2. The low-smoke producing pyrotechnic composition of claim 1 wherein said metal salt includes a metal selected from the group consisting of calcium, barium, strontium, potassium, iron, sodium, copper and antimony.

3. The low-smoke producing pyrotechnic composition of claim 1 wherein said low smoke fuel is from the group of dihydrazino-s-tetrazine, derivatives of dihydrazino-s-tetrazine and salts of dihydrazino-s-tetrazine.

4. The low-smoke producing pyrotechnic composition of claim 1 wherein said oxidant is selected from the group consisting of ammonium perchlorate and ammonium nitrate.

5. A blue emitting pyrotechnic composition comprised of a high-nitrogen content, lowcarbon content energetic material selected from the group consisting of 5,5'-bis-1H-tetrazole, salts of 5,5'-bis-1H-tetrazole, bis(1(2)H-tetrazol-5-yl)-amine, the monohydrate of bis(1(2)H-tetrazol-5-yl) amine, salts of bis(1(2)H-tetrazol-5-yl)-amine, dihydrazino-s-tetrazine, derivatives of dihydrazino-s-tetrazine and salts of dihydrazino-s-tetrazine, an oxidizer and a copper salt of a high-nitrogen content, low-carbon content energetic material selected from the group consisting of 5,5'-bis-1H-tetrazole, bis(1(2)H-tetrazol-5-yl)-amine, and the monohydrate of bis(1(2)H-tetrazol-5-yl)-amine, said blue emitting pyrotechnic composition further characterized as having C.I.E. 1931 chromaticity diagram index values of $x<0.20$ and $y<0.18$.

6. A composition of matter comprising a salt of 5,5'-bis-1H-tetrazole, said salt including a cation selected from the group consisting of $NH_2NH_3^+$, $NH_3OH^+$, $Sr^+$ and $^+H_3NHN—(C_2N_4)—NHNH_3^+$ wherein said $(C_2N_4)$ is a tetrazine ring system.

* * * * *